US007161457B2

(12) United States Patent
Meadors et al.

(10) Patent No.: US 7,161,457 B2
(45) Date of Patent: Jan. 9, 2007

(54) COMMON MODE CHOKE INCLUDING CONDUCTORS WITHIN DIELECTRIC LAYER AND ASSOCIATED METHODS

(75) Inventors: Richard W. Meadors, Chattanooga, TN (US); Henry G. Paris, Chattanooga, TN (US); James A. Fitzsimmons, Hixson, TN (US)

(73) Assignee: Steward, Inc., Chattanooga, TN (US)

( * ) Notice: Subject to any disclaimer, the term of this patent is extended or adjusted under 35 U.S.C. 154(b) by 0 days.

(21) Appl. No.: 11/320,179

(22) Filed: Dec. 28, 2005

(65) Prior Publication Data

US 2006/0158294 A1 Jul. 20, 2006

Related U.S. Application Data

(60) Provisional application No. 60/640,701, filed on Dec. 30, 2004.

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 5,359,311 A * 10/1994 Kawabata et al. ..... 336/83
5,455,552 A 10/1995 Metsler ..... 336/65
5,551,146 A * 9/1996 Kawabata et al. ..... 29/608
6,012,219 A * 1/2000 Kato et al. ..... 29/606
6,121,852 A * 9/2000 Mizoguchi et al. ..... 333/35
6,137,389 A * 10/2000 Uchikoba ..... 336/83
6,288,626 B1 9/2001 Cameron et al. ..... 336/200

FOREIGN PATENT DOCUMENTS

JP 04-051503 * 2/1992

* cited by examiner

*Primary Examiner*—Tuyen T Nguyen
(74) *Attorney, Agent, or Firm*—Allen, Dyer, Doppelt, Milbrath & Gilchrist, P.A.

(57) ABSTRACT

A common mode choke may include a generally rectangular body including bottom and top ferrite portions, at least one pair of laterally spaced apart interior conductors between the bottom and top ferrite portions and extending between the first and second ends of the generally rectangular body, and a dielectric material layer between the bottom and top ferrite portions. Moreover, the dielectric material layer may also extend laterally between the at least one pair of interior conductors and may also at least partially encapsulate the at least one pair of interior conductors at portions thereof opposite at least one of the bottom and top ferrite portions. The choke may also include end conductors on the opposite ends of the generally rectangular body and connected to the interior conductors. A compact footprint is provided for the common mode choke while maintaining a high level of electrical performance.

16 Claims, 8 Drawing Sheets

COMMON MODE CHOKE INCLUDING CONDUCTORS WITHIN DIELECTRIC LAYER AND ASSOCIATED METHODS

RELATED APPLICATION

The present application is based upon U.S. Provisional Application No. 60/640,701 filed Dec. 30, 2004, the entire contents of which are incorporated herein by reference.

FIELD OF THE INVENTION

This invention is related to the field of electronic devices, and, more particularly, to the field of ferrite inductive components, such as common mode chokes for circuit board mounting.

BACKGROUND OF THE INVENTION

Chokes are commonly used in electronic circuits to block signal frequencies above a desired range, while at the same time allowing DC or low frequency signals to pass. Thus, chokes have been employed to prevent electromagnetic interference (EMI) from disturbing various electronic devices. EMI is generated, for example, as a byproduct of switching regulators that have current and voltage waveforms with fast rise and fall times. Because switching regulators are typically contained in power supplies, EMI may be transmitted through an electronic device via the power supply conductors. Excessive EMI can lead to logic errors in a computer and can cause interference with other adjacent electronic components. Of course, there are many other applications where a choke may be needed to filter unwanted signals.

A choke is typically provided by a magnetic core through which, or around which, conductors or windings are positioned. Thus, a typical choke defines first and second mutually coupled magnetic paths. A choke may be schematically represented as a low pass filter. For any choke to function as intended, its inductance or inductive reactance, should not fall below a specific minimum, even though the current in a winding rises to a maximum value. Beyond the maximum current value, the reactance falls off significantly. The choke's ability to impede interference signals drops, thereby allowing the passage of unwanted signals. It is therefore typically desirable to prevent a choke from being driven into such a saturation condition.

Ferrite materials are commonly used as the core material for many chokes because, for example, ferrites have sensitive magnetic-frequency relationships. The ferrite material used to form the choke will determine which signal frequencies the choke will attenuate. Most ferrites having suitable inductance values for choke applications saturate at less than about 4,000 Gauss. Accordingly, when configured differentially, ferrites have a relatively low current carrying capacity before the choke is driven into saturation and its impedance level deteriorates at the desired filter frequency.

The techniques normally used to prevent this saturation are to provide a core air gap, use a larger cross-section core, or simply to limit the allowable current. An example of a choke with a core having an air gap is illustrated in U.S. Pat. No. 5,455,552, assigned to the assignee of the present invention. The choke represents a significant advance in technology and includes a ferrite body through which a pair of spaced apart vertical slotted openings are formed. Pairs of spaced apart electrical conductors extend from the bottom of the device, vertically to the top of the device through one slot, along the top of the device, and back down vertically through the other slot of the device. The conductors are configured for common mode operation to mitigate the saturation difficulties. In other words, by bringing the high side and ground return through the same core opposing fields are produced in the core which tend to cancel.

While chokes are commonly applied directly to printed circuit boards, in such applications it is typically undesirable to use chokes with large cores or gapped sections. Accordingly, the compact ferrite structure as disclosed in U.S. Pat. No. 5,455,552 is advantageous for circuit board mounting. Unfortunately, the physical positioning of the discrete conductors through the vertically extending slots requires additional efforts during manufacturing.

A further advance in the area of ferrite chokes is disclosed in U.S. Pat. No. 6,288,626, assigned to the assignee of the present invention and the entire contents of which are incorporated herein by reference. This patent discloses a punching operation to provide an air gap between the parallel conductors within a ferrite body. The choke, however, requires a relatively large footprint for a given electrical performance.

SUMMARY OF THE INVENTION

In view of the foregoing background, it is therefore an object of the present invention to provide a common mode choke and associated manufacturing method that provides a choke with a more compact footprint for equivalent electrical performance.

This and other objects, features and advantages in accordance with the present invention are provided by a common mode choke comprising a generally rectangular body including bottom and top ferrite portions, at least one pair of laterally spaced apart interior conductors between the bottom and top ferrite portions and extending between the first and second ends of the generally rectangular body, and a dielectric material layer between the bottom and top ferrite portions. Moreover, the dielectric material layer may also extend laterally between the at least one pair of interior conductors and may also at least partially encapsulate the at least one pair of interior conductors at portions thereof opposite at least one of the bottom and top ferrite portions. The choke may also include end conductors on the opposite ends of the generally rectangular body and connected to the interior conductors. Accordingly, a compact footprint is provided for the common mode choke while maintaining a high level of electrical performance.

The dielectric material layer may at least partially encapsulate the at least one pair of interior conductors at portions thereof opposite both the bottom and top ferrite portions. The dielectric material layer may only partially encapsulate the at least one pair of interior conductors. In other words, the dielectric material layer need not fully encapsulate the interior conductors.

The at least one pair of interior conductors may have outwardly diverging end portions at respective first and second ends of the generally rectangular body. In addition, the dielectric material layer may have enlarged width end portions at respective first and second ends of the generally rectangular body. In other words, the interior conductors themselves may be printed close together and maintain this spacing until relatively close to each end, where they flare out to provide separation for the solderable end terminations. This configuration results in similar performance in a smaller package because it allows the use of the full length of the component, not available with the previous punched or notched choke.

The generally rectangular body may also have opposing sides extending between the first and second ends. Accordingly, the at least one pair of interior conductors may be spaced inwardly from the opposing first and second sides. Each of the interior conductors may have a strip shape as formed by screen printing, for example. The dielectric material layer may comprise a non-magnetic dielectric material, such as titania, for example. Accordingly, the non-magnetic dielectric layer may provide a non-magnetic and resistive barrier between the interior conductors. In addition, the bottom and top ferrite portions may each comprise a respective plurality of ferrite layers joined together. The thicker ferrite portions may provide different desired filtering characteristics.

A method aspect of the invention is for making a common mode choke. The method may include forming a generally rectangular body having opposing first and second ends and comprising a bottom ferrite portion, a top ferrite portion adjacent the bottom ferrite portion, and at least one pair of laterally spaced apart interior conductors between the bottom and top ferrite portions and extending between the first and second ends of the generally rectangular body. The method may also include forming the body to comprise a dielectric material layer between the bottom and top ferrite portions so as to extend laterally between the at least one pair of interior conductors and to also at least partially encapsulate the at least one pair of interior conductors at portions thereof opposite at least one of the bottom and top ferrite portions. In addition, the method may include forming end conductors connected to the interior conductors. Forming the generally rectangular body may comprise screen printing the at least one pair of interior conductors and screen printing the dielectric material layer, for example.

DETAILED DESCRIPTION OF THE INVENTION

Figure 1:
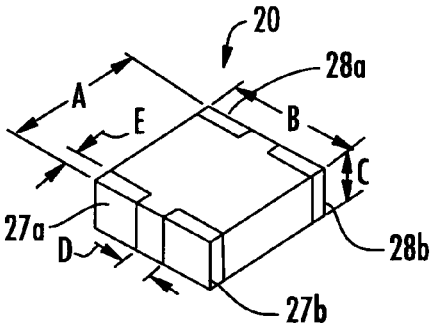
FIG. 1 is a perspective view of a first embodiment of a common mode choke in accordance with the invention.
Figure 2:
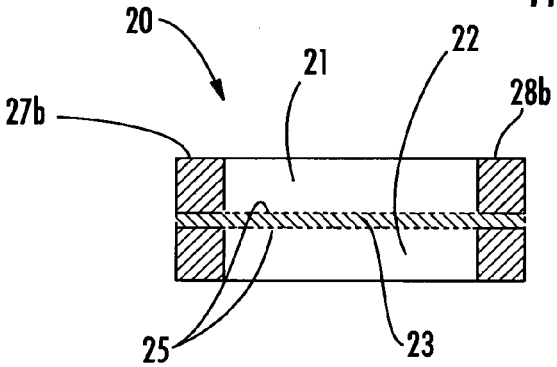
FIG. 2 is a longitudinal side cross-sectional view of the choke as shown in FIG. 1.
Figure 3:
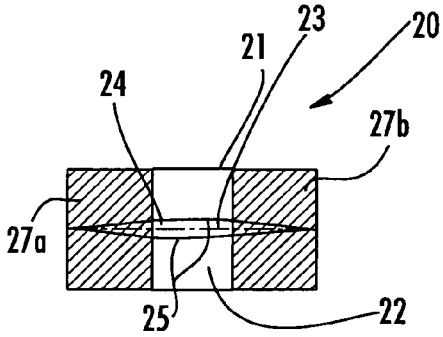
FIG. 3 is an end elevational view of the choke as shown in FIG. 1.
Figure 4:
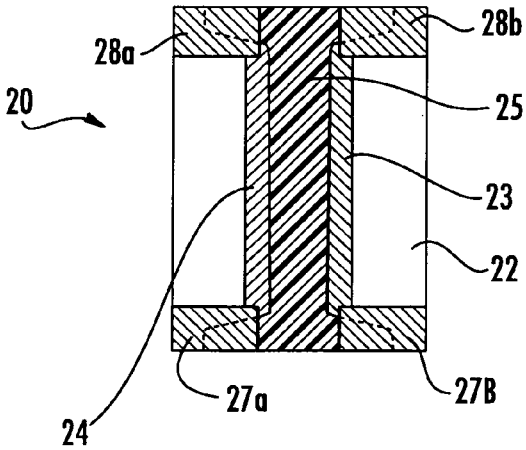
FIG. 4 is a longitudinal top cross-sectional view of the choke as shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation and multiple prime notation are used to indicate similar elements in alternate embodiments.

FIGS. 1–4 show a first embodiment of the common mode choke 20 under the assignee's model designation CM1812X330R-00 that includes upper and lower layers of ferrite tape 21, 22 with end conductor pairs 27*a*, 27*b* and 28*a*, 28*b*. More particularly, the choke 20 includes a pair of spaced apart longitudinally extending parallel interior conductors 23 and 24 between the upper and lower ferrite tape layers 21, 22. For clarity of explanation these conductors 23 and 24 are referred to herein as interior conductors to differentiate them from the end conductors 27*a*–28*b* as will be appreciate by those skilled in the art.

For example, the interior conductors 23, 34 may maintain a 0.010 inch spacing to within 0.015 inch of the end where they flare out to 0.050 inches to provide separation for the solderable terminations or end conductors 27*a*–28*b*. Of course, in other embodiments, the spacing to the end could be even closer, such as on the order of 0.002 to 0.003 inches, for example.

The height or thickness of the interior conductors 23, 24 creates a tunnel between them. A dielectric material layer 25 partially encapsulates the conductors 23, 24 in the illustrated embodiment. The dielectric material layer 25 is below the conductors 23, 24, within the tunnel between the conductors, and overlying the tunnel and adjacent portions of the conductors. The dielectric material layer may be a titania layer, for example, although other materials are also possible as will be appreciated by those skilled in the art. The width of each conductor 23, 24 may be 0.025 inch, for example, such as used for the CM1812X330R-00 choke 20.

TABLE 1 below lists representative dimensions and characteristics for the common mode choke 20.

TABLE 1

| Electrical Characteristics | | | | | | | | | |
|---|---|---|---|---|---|---|---|---|---|
| NET Z @ 100 MHz | | | DCR Max | | | | Rated Current mA | | |
| 33 | | | 0.003 | | | | 10000 | | |
| Physical Dimensions | | | | | | | | | |
| A mm | B mm | C mm | D mm | E mm | A in | B in | C in | D in | E in |
| 4.57 | 3.05 | 1.60 | 1.14 | 0.58 | 0.180 | 0.120 | 0.063 | 0.045 | 0.023 |

Figure 5:
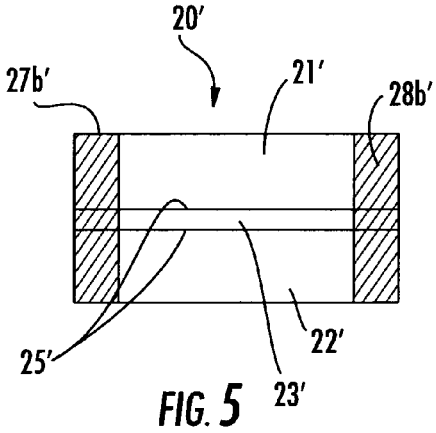
FIG. 5 is a longitudinal side cross-sectional view of another embodiment of a choke in accordance with the present invention.
Figure 6:
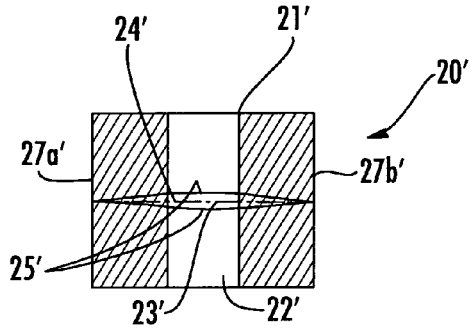
FIG. 6 is an end elevational view of the choke as shown in FIG. 5.
Figure 7:
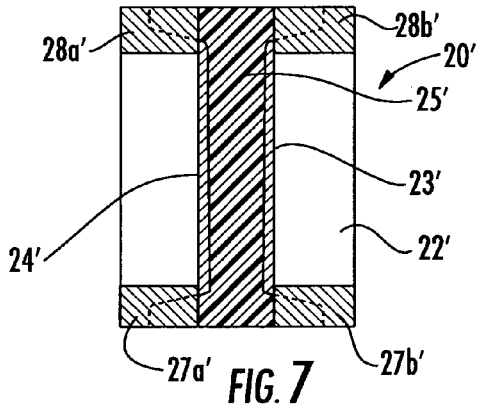
FIG. 7 is a longitudinal top cross-sectional view of the choke as shown in FIG. 5.

FIGS. 5–7 show a second embodiment of a common mode choke 20' under the assignee's model designation CM1812R600R-00. In this embodiment, the choke 20' has more narrow interior conductors 23', 24' to yield a higher impedance of 60 Ohms. In particular, the lateral width of each interior conductor 23', 24' may be 0.015 inch. The other elements are indicated with prime notation and need no further discussion herein.

Figure 8:
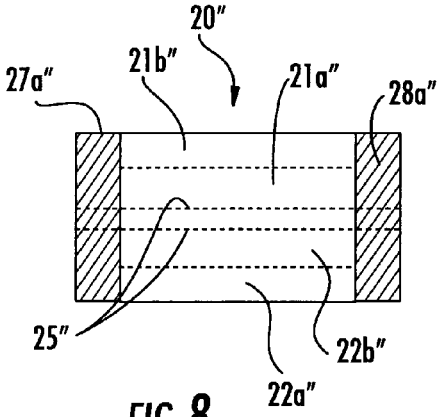
FIG. 8 is a longitudinal side cross-sectional view of yet another embodiment of a choke in accordance with the present invention.
Figure 9:
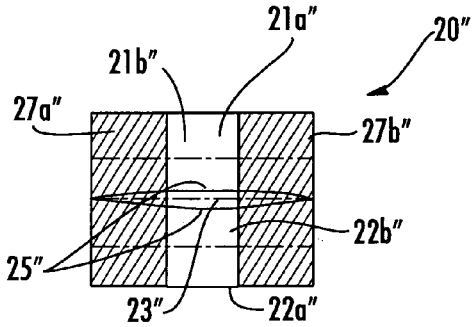
FIG. 9 is an end elevational view of the choke as shown in FIG. 8.
Figure 10:
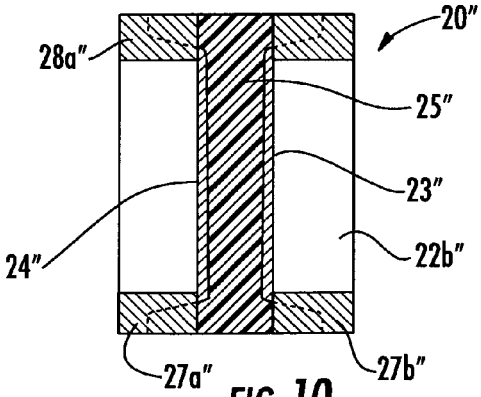
FIG. 10 is a longitudinal top cross-sectional view of the choke as shown in FIG. 8.
Figure 11:
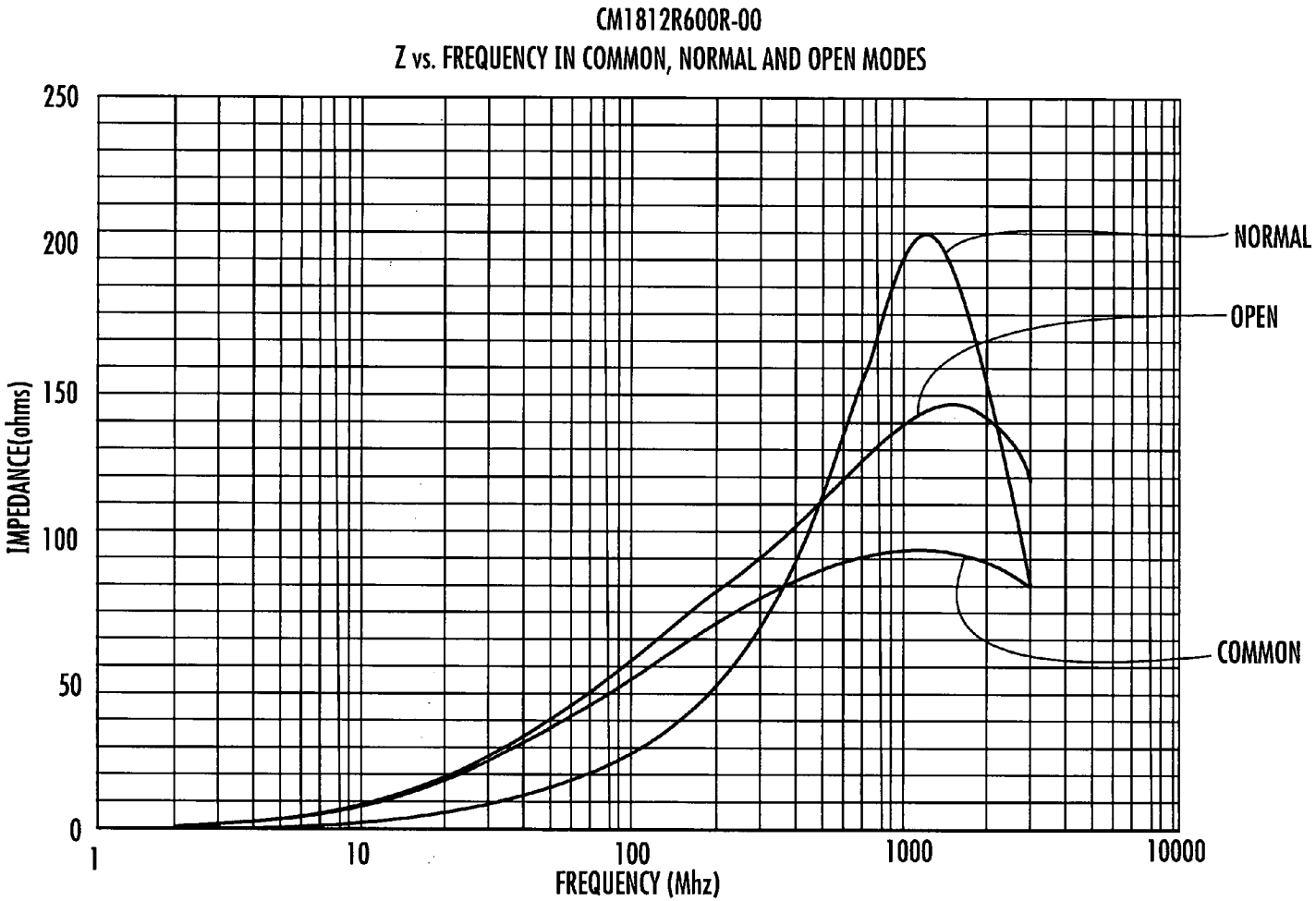
FIG. 11 is a graph including plots of impedance versus frequency for a sample choke in accordance with the present invention in common, normal and open modes.

Turning now additionally to FIGS. 8–10, yet another embodiment of a common mode choke 20" is now described. This choke 20" is similar to the choke 20' described above with reference to FIGS. 5–7, but in this embodiment, four ferrite layers 21*a*", 21*b*", 22*a*", 22*b*" are used to form the generally rectangular ferrite body. In other words, the lower ferrite portion includes layers 22*a*", and 22*b*", while the upper ferrite portion includes layers 21*a*", 21*b*" as shown in the illustrated embodiment. The other elements are indicated with double prime notation and are similar to those already discussed.

Figure 12:
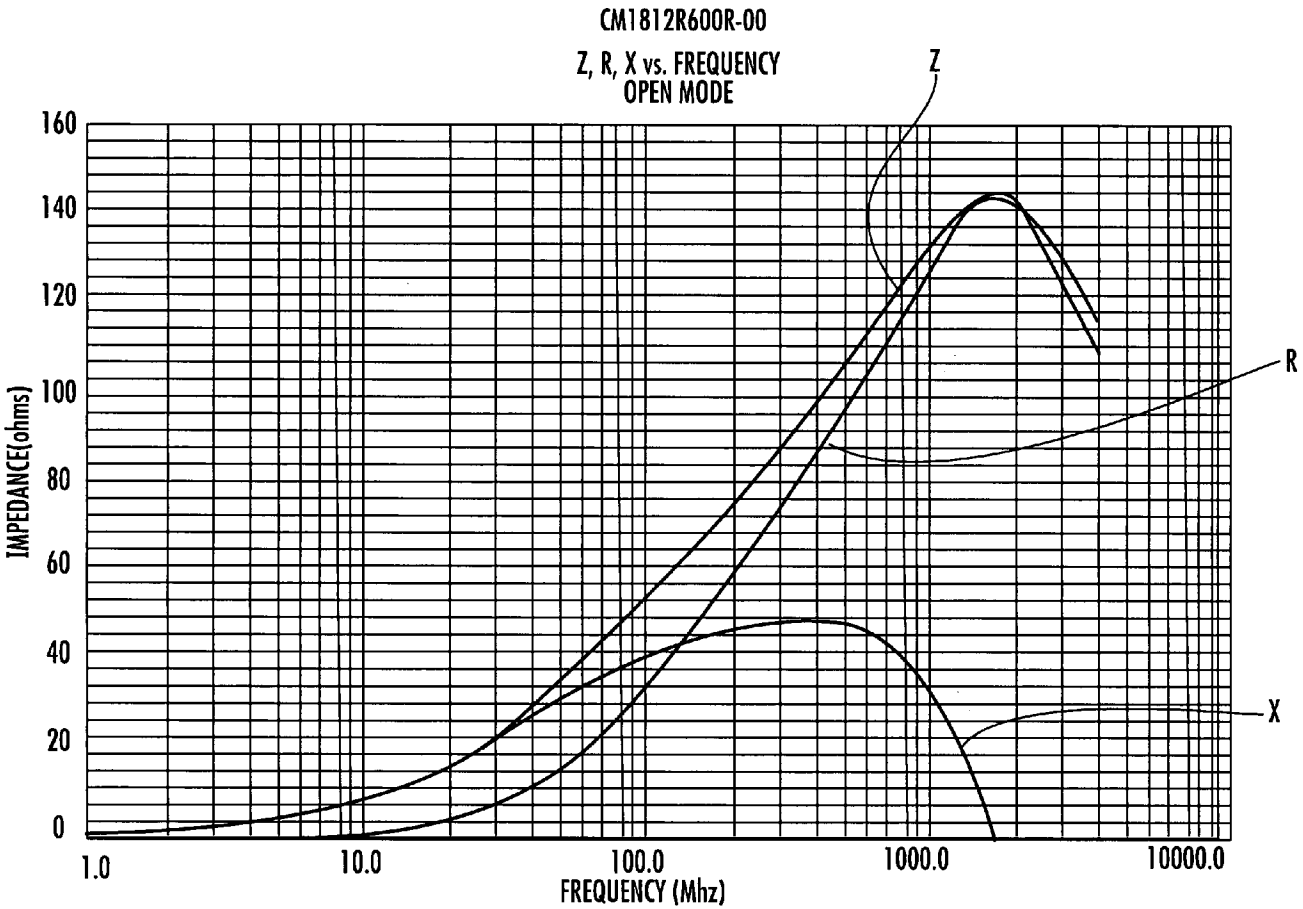
FIG. 12 is a graph including plots of impedance, resistance and inductive reactance versus impedance for a sample choke in accordance with the invention in an open mode.

The performance of samples of the common mode chokes in accordance with the present invention is demonstrated by the plots of FIGS. 11–15. More particularly, FIG. 11 includes plots of the impedance (Z) versus frequency in the normal, open and common modes for a CM1812R600R-00 sample choke. FIG. 12 includes plots of the impedance (Z), resistance (R), and inductive reactance (X} in the open mode for a CM1812R600R-00 sample choke.

Figure 13:
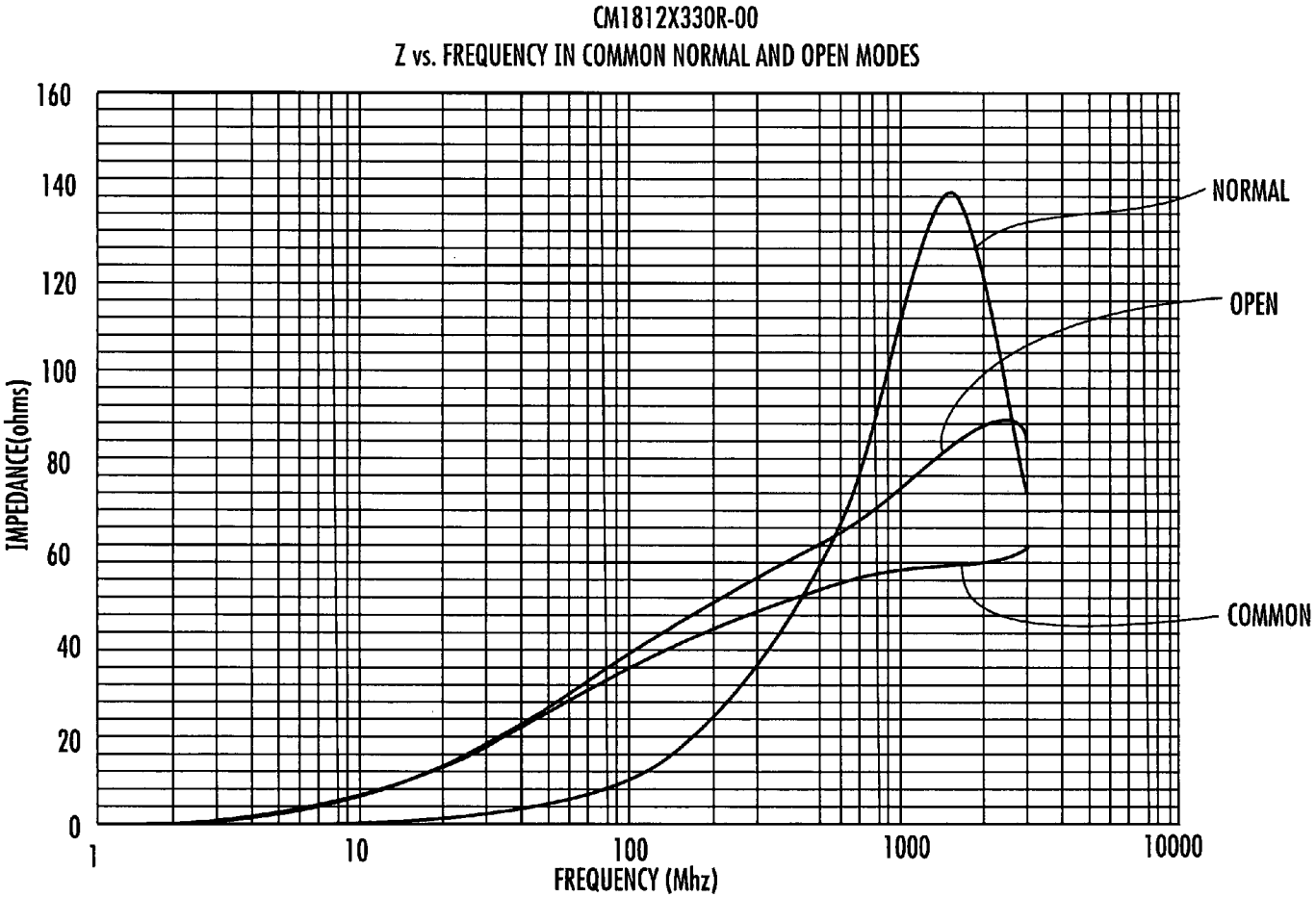
FIG. 13 is a graph including plots of impedance versus frequency for another sample choke in accordance with the present invention in common, normal and open modes.
Figure 14:
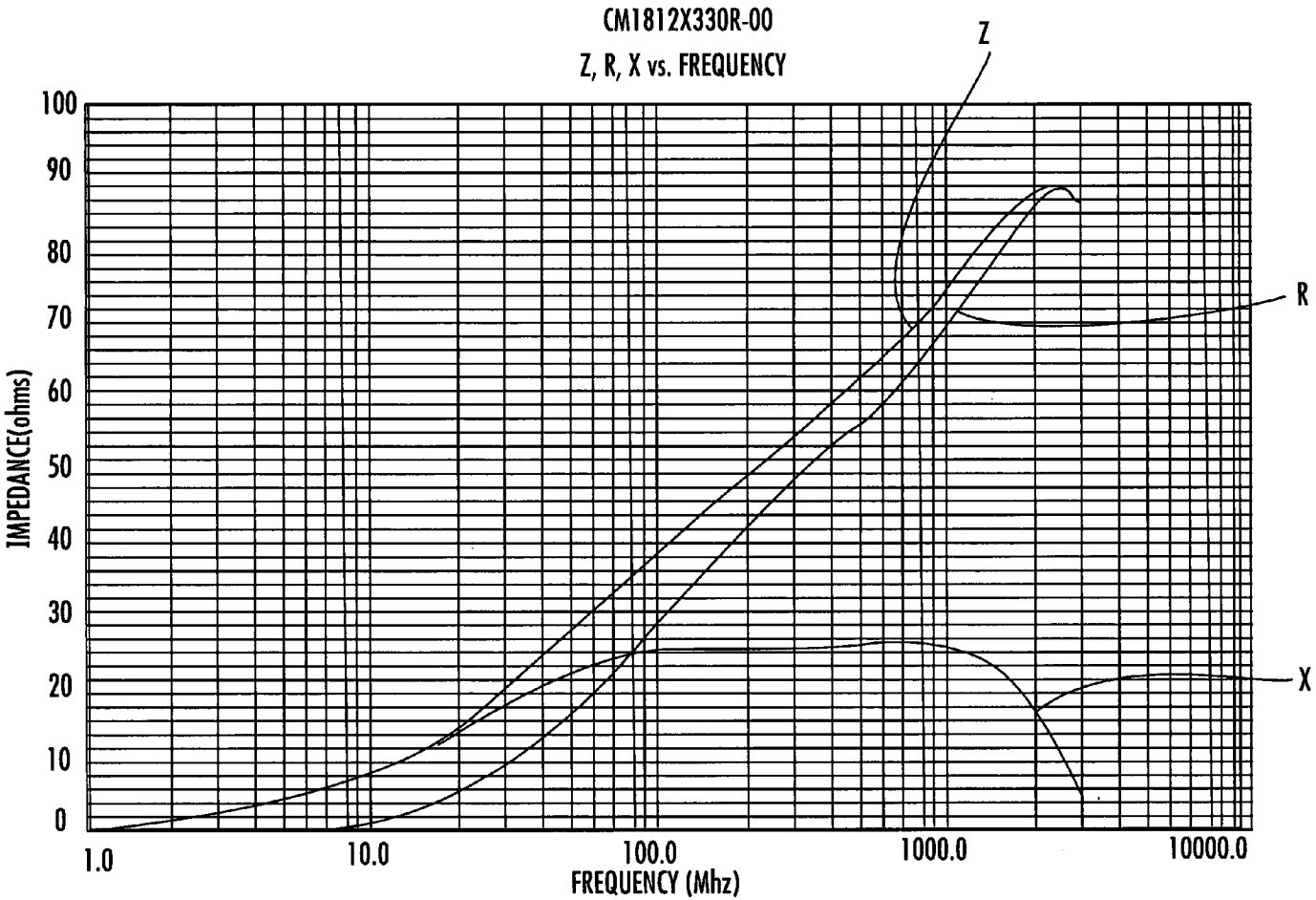
FIG. 14 is a graph including plots of impedance, resistance and inductive reactance versus frequency for another sample choke in accordance with the invention in an open mode.

FIG. 13 includes plots of the impedance (Z) versus frequency in the normal, open and common modes for a CM1812X330R-00 sample choke. FIG. 14 includes plots of the impedance, resistance, and inductive reactance in the open mode for a CM1812X330R-00 sample choke.

Figure 15:
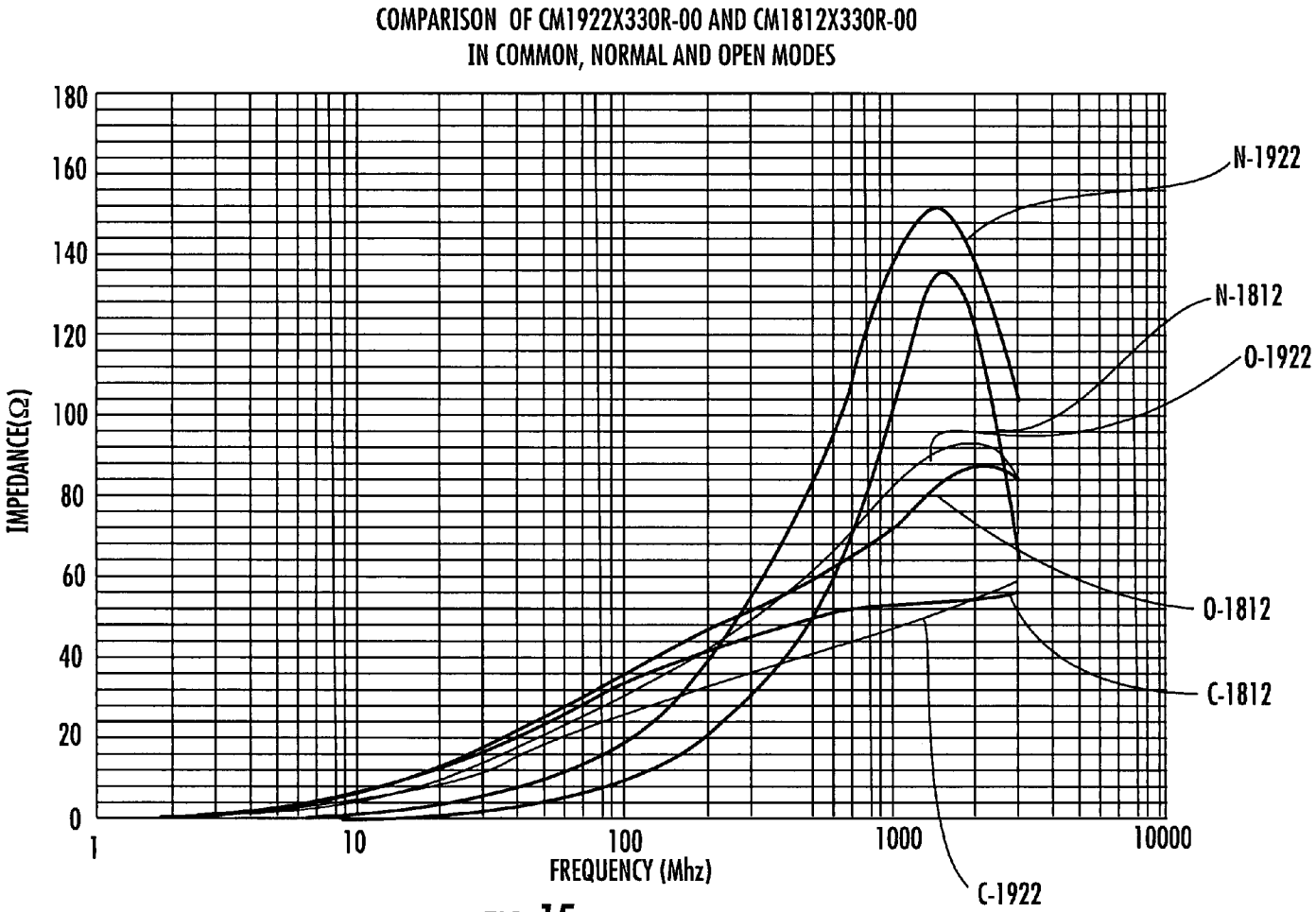
FIG. 15 is a graph of comparative plots of impedance versus frequency for a prior art choke and a sample choke in accordance with the present invention in common, normal and open modes.
Figure 16:
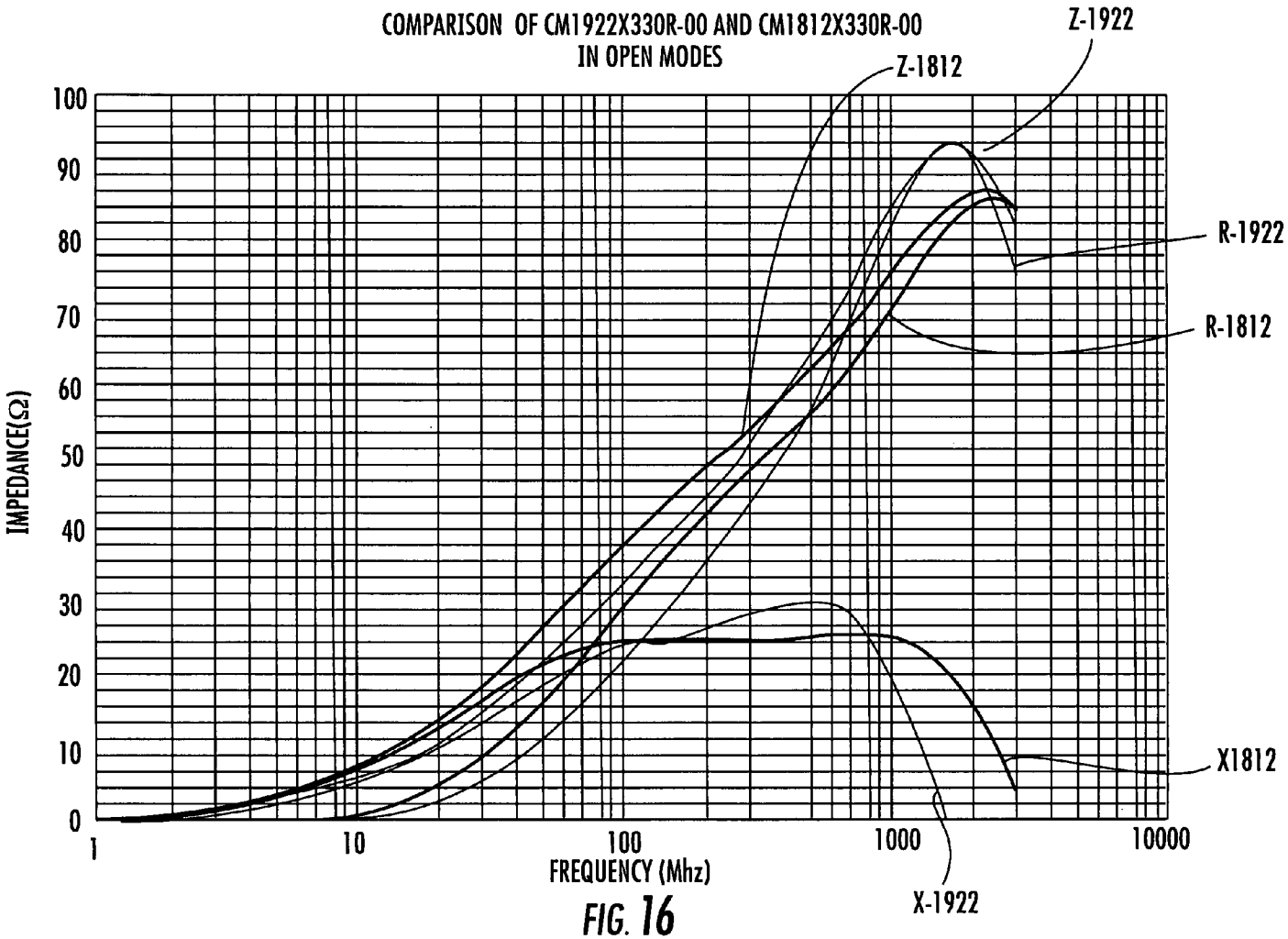
FIG. 16 is a graph of comparative plots of impedance, resistance and inductive reactance versus frequency for a prior art choke and a sample choke in accordance with the present invention in an open mode.

FIGS. 15 and 16 include comparative plots for performance of a CM1812X330R-00 sample choke in accordance with the invention and a CM1922X330R-00 sample choke as in the prior art and having about twice the footprint of the CM1812X330R-00 sample choke. FIG. 15 includes the comparative plots of impedance (Z) versus frequency in the normal, open and common modes. FIG. 16 includes the comparative plots of impedance (Z), resistance (R), and inductive reactance (X) in the open mode. What can be seen is that the sample choke in accordance with the present invention has about half the footprint of a conventional part of similar performance.

The common mode chokes in accordance with the invention may be fabricated by depositing a lower titania layer on the lower ferrite layer, screening the conductors over the lower titania layer, depositing a second titania layer over the conductors and filling the space between the conductors, applying the upper ferrite layer and sintering the body. Other fabrication methods are also contemplated by the present invention. For example, the titania layer may not be needed on both the top and bottom.

The common mode choke represents an advancement in the design of the monolithic common mode choke, such as disclosed in the above noted U.S. Pat. No. 6,288,626 so as to provide a decreased footprint while maintaining similar electrical performance. While the previous common mode choke relied on a punching operation to provide an air gap between the conductors, the common mode choke of the invention may achieve this with a dielectric layer printed between the interior conductors, thereby eliminating the need for a gap through the component.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included.

That which is claimed is:

1. A common mode choke comprising:

a generally rectangular body having opposing first and second ends and comprising a bottom ferrite portion, a top ferrite portion adjacent said bottom ferrite portion, at least one pair of laterally spaced apart interior conductors between said bottom and top ferrite portions and extending between the first and second ends of the generally rectangular body, and a dielectric material layer between said bottom and top ferrite portions so as to extend laterally between said at least one pair of interior conductors and to also at least partially encapsulate said at least one pair of interior conductors at portions thereof opposite at least one of said bottom and top ferrite portions;

at least one first pair of end conductors on the first end of the generally rectangular body and connected to said at least one pair of interior conductors; and at least one second pair of end conductors on the second end of the generally rectangular body and connected to said at least one pair of interior conductors.

2. A common mode choke according to claim 1 wherein said dielectric material layer at least partially encapsulates said at least one pair of interior conductors at portions thereof opposite both said bottom and top ferrite portions.

3. A common mode choke according to claim 1 wherein said dielectric material layer only partially encapsulates said at least one pair of interior conductors at portions thereof opposite at least one of said bottom and top ferrite portions.

4. A common mode choke according to claim 1 wherein said at least one pair of interior conductors has outwardly diverging end portions at respective first and second ends of the generally rectangular body.

5. A common mode choke according to claim 4 wherein said dielectric material layer has enlarged width end portions at respective first and second ends of the generally rectangular body.

6. A common mode choke according to claim 1 wherein the generally rectangular body also has opposing sides extending between the first and second ends; and wherein said at least one pair of interior conductors are spaced inwardly from the opposing first and second sides.

7. A common mode choke according to claim 1 wherein each interior conductor of said at least one pair thereof has a strip shape.

8. A common mode choke according to claim 1 wherein said dielectric material layer comprises a non-magnetic dielectric material.

9. A common mode choke according to claim 1 wherein said dielectric material layer comprises titania.

10. A common mode choke according to claim 1 wherein said bottom and top ferrite portions each comprises a respective plurality of ferrite layers joined together.

11. A common mode choke comprising:

a generally rectangular body having opposing first and second ends and comprising a bottom ferrite portion, a top ferrite portion adjacent said bottom ferrite portion, at least one pair of laterally spaced apart interior conductors between said bottom and top ferrite portions and extending between the first and second ends of the generally rectangular body, and a non-magnetic dielectric material layer between said bottom and top ferrite portions so as to extend laterally between said at least one pair of interior conductors and to also at least partially encapsulate said at least one pair of interior conductors at portions thereof opposite both said bottom and top ferrite portions;

at least one first pair of end conductors on the first end of the generally rectangular body and connected to said at least one pair of interior conductors; and at least one second pair of end conductors on the second end of the generally rectangular body and connected to said at least one pair of interior conductors.

12. A common mode choke according to claim 11 wherein said non-magnetic dielectric material layer only partially encapsulates said at least one pair of interior conductors at portions thereof opposite both said bottom and top ferrite portions.

13. A common mode choke according to claim 11 wherein said at least one pair of interior conductors has outwardly diverging end portions at respective first and second ends of the generally rectangular body; and wherein said non-magnetic dielectric material layer has enlarged width end portions at respective first and second ends of the generally rectangular body.

14. A common mode choke according to claim 11 wherein the generally rectangular body also has opposing sides extending between the first and second ends; and wherein said at least one pair of interior conductors are spaced inwardly from the opposing first and second sides.

15. A common mode choke according to claim 11 wherein each interior conductor of said at least one pair thereof has a strip shape.

16. A common mode choke according to claim 11 wherein said bottom and top ferrite portions each comprises a respective plurality of ferrite layers joined together.

* * * * *